US006390199B1

(12) United States Patent
Heijnen

(10) Patent No.: US 6,390,199 B1
(45) Date of Patent: May 21, 2002

(54) DOWNHOLE SAFETY VALVE

(75) Inventor: Wilhelmus Hubertus Paulus Maria Heijnen, Nienhagen (DE)

(73) Assignee: Shell Oil Company, Houston, TX (US)

( * ) Notice: Subject to any disclaimer, the term of this patent is extended or adjusted under 35 U.S.C. 154(b) by 0 days.

(21) Appl. No.: 09/654,756

(22) Filed: Sep. 5, 2000

(30) Foreign Application Priority Data

Sep. 21, 1999 (EP) ..... 99307441

(51) Int. Cl.[7] ..... E21B 34/08; F16K 17/34

(52) U.S. Cl. ..... 166/319; 166/373; 137/460; 137/498; 137/509

(58) Field of Search ..... 137/469, 486, 137/498, 509, 12, 460; 166/319, 332.8, 373, 330; 251/28, 29, 305

(56) References Cited

U.S. PATENT DOCUMENTS 2,370,584 A * 2/1945 Schneider ..... 287/53
4,708,163 A * 11/1987 Deaton ..... 137/460
4,911,199 A * 3/1990 Bontenbal et al. ..... 137/460
5,979,870 A * 11/1999 Junier ..... 251/305
6,233,919 B1 * 5/2001 Abel et al. ..... 60/204

* cited by examiner

*Primary Examiner*—David Bagnell
*Assistant Examiner*—Daniel P Stephenson

(57) ABSTRACT

A safety valve for use in a wellbore formed in an earth formation, comprising a valve body having a fluid passage for passage of a stream of hydrocarbon fluid flowing from the earth formation via the wellbore to the earth surface, a closure member movable relative to the valve body between an open position in which the fluid passage is open and a closed position in which the closure member closes the fluid passage, and an activating device for selectively subjecting the closure member to a drag force of selected magnitude, the drag force being exerted by the stream of fluid and inducing the closure member to move from the open position to the closed position thereof.

The safety valve further comprises control means for controlling the activating device to subject the closure member to said drag force.

17 Claims, 2 Drawing Sheets

DOWNHOLE SAFETY VALVE

BACKGROUND OF THE INVENTION

The present invention relates to a safety valve for use in a wellbore formed in an earth formation, comprising a valve body having a fluid passage for passage of a stream of hydrocarbon fluid flowing from the earth formation via the wellbore to the earth surface, a closure member movable relative to the valve body between an open position in which the fluid passage is open and a closed position in which the closure member closes the fluid passage. The safety valve serves to shut down production from the wellbore either by control from surface or automatically in case of undesirable flow conditions. The latter situation occurs for example in case of increased hydrocarbon fluid flow rate as a result of an accident at a surface production facility. Therefore it is generally aimed to design a safety valve for a wellbore such that the valve closes upon the flow rate in the wellbore reaching a selected threshold flow rate.

However, experience has shown that conventional safety valves generally have a low accuracy with regard to the flow rate at which the valve closes.

SUMMARY OF THE INVENTION

It is an object of the invention to provide an improved downhole safety valve which overcomes the drawbacks of the conventional downhole safety valves.

In accordance with the invention there is provided a safety valve for use in a wellbore formed in an earth formation, comprising a valve body having a fluid passage for passage of a stream of hydrocarbon fluid flowing from the earth formation via the wellbore to the earth surface;

a closure member movable relative to the valve body between an open position in which the fluid passage is open and a closed position in which the closure member closes the fluid passage;

an activating device for selectively subjecting the closure member to a drag force of selected magnitude, the drag force being exerted by the stream of fluid and inducing the closure member to move from the open position to the closed position thereof; and control means for controlling the activating device to subject the closure member to said drag force.

By selectively subjecting the closure member to the drag force it is achieved that a step-change in the resulting force acting on the closure member is created rather than a gradual change as in conventional safety valves. As a result the closure member closes the fluid passage in response to the step-change of force. It is to be understood that the drag force can act directly onto the closure member or onto a drag surface connected to the closure member.

Suitably the activating device is operable between a first mode in which flow of the stream of fluid against the closure member is substantially prevented, and a second mode in which flow of the stream of fluid against the closure member is allowed.

In a preferred embodiment the closure member is arranged in a conduit and wherein in said first mode the activating device substantially prevents flow of the stream of fluid into the conduit, and in said second mode the activating device allows flow of the stream of fluid into the conduit.

Preferably the activating device includes a flapper valve having a flapper element arranged upstream the closure member, which flapper element in said first mode substantially closes the conduit and in said second mode substantially leaves the conduit open.

The invention will be described hereinafter in more detail and by way of example with reference to the accompanying drawings in which:

BRIEF DESCRIPTION OF THE DRAWINGS

A better understanding of the present invention may be obtained by reference to the following drawings when read in conjunction with the specification.

DETAILED DESCRIPTION OF THE PREFERRED EMBODIMENT

Figure 1:
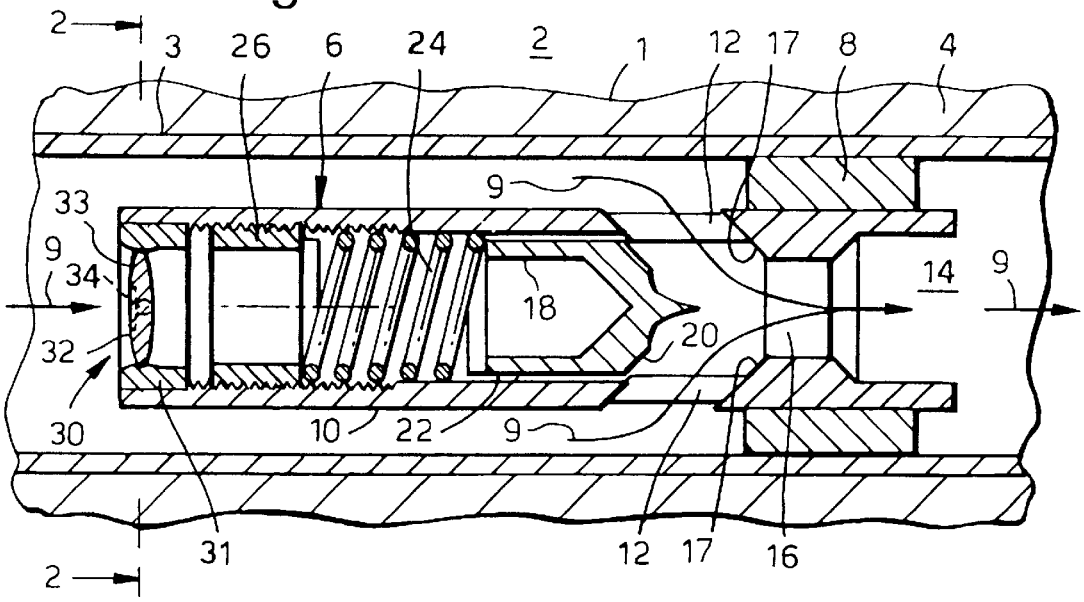
FIG. 1 schematically shows a longitudinal cross-section of an embodiment of a downhole safety valve according to the invention.

In FIG. 1 is shown a wellbore 1 formed into an earth formation 2 for the production of a stream of hydrocarbon gas. The wellbore 1 is provided with a casing 3 fixed in the wellbore by a layer of cement 4. A downhole safety valve 6 according to the invention is concentrically arranged in the casing 3 and fixed to the casing by a packer 8 which prevents hydrocarbon gas from bypassing the safety valve 6. The direction of flow of the gas is indicated by arrows 9.

The safety valve 6 includes a conduit in the form of tubular valve body 10 having a plurality of gas inlets in the form of slots 12 provided in the tubular valve body and a gas outlet 14 in fluid communication with the slots 12 via a valve opening 16. A valve seat 17 extends around the valve opening 16 at the upstream side thereof. A closure member 18 is arranged in the valve body 10, the closure member having a front surface 20 matching the valve seat 17. The closure member 18 is movable in axial direction of the valve body 10 between an open position (as shown in FIG. 1) in which the front surface 20 is located away from the valve seat 17 and a closed position in which the front surface 20 contacts the valve seat 17 and thereby closes the valve. A small radial clearance 22 is present between the outer surface of the closure member 18 and the inner surface of the valve body 10. A spiral tension spring 24 is provided in the tubular valve body 10, one end of the spring 24 being connected to the closure member 18, the other end to a stop member 26 arranged in the valve body. The stop member 26 is adjustable in axial direction of the valve body 10 in order to adjust the tension force of the spring 24. When in rest position, the spring 24 holds the closure member 18 in the open position thereof.

Figure 2:
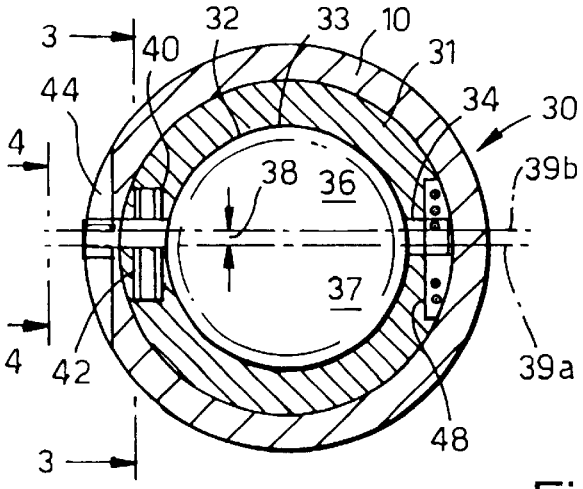
FIG. 2 schematically shows cross-section 2—2 of FIG. 1.

Referring further to FIG. 2, the upstream end part of the valve body 10 is provided with an activating device in the form of a flapper valve 30 operable between a closed mode in which flow of the stream of gas against the 18 closure member is substantially prevented, and an open mode in which flow of the stream of gas into the valve body 10 and against the closure member 18 is allowed. The flapper valve 30 includes a flapper body 31 arranged inside the tubular valve body 10 and having a flow opening 33, and a flapper element 32 connected to a rotatable shaft 34 which divides the flapper element 32 in portions 36, 37 of different surface areas. To illustrate this arrangement, the eccentricity between axis of symmetry 39*a* of the flapper element and the longitudinal axis 39*b* of the shaft 34 has been indicated in FIG. 2 by reference sign 38.

Figure 3:
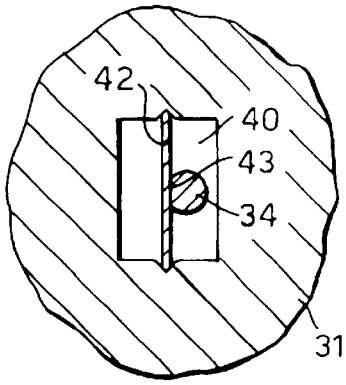
FIG. 3 schematically shows cross-section 3—3 of FIG. 2.

Referring further to FIG. 3, the rotatable shaft 34 extends through a chamber 40 provided in the valve body 31. The shaft 34 has a cam surface formed by a flat surface portion 43 of the shaft, the flat surface portion 43 extending parallel to the flapper element 32 and being located in the chamber 40. The remaining surface of the axis 34 has a circular cross-section. A leaf spring 42 is arranged in the chamber 40 so that both ends of the leaf string 42 are fixed to the walls of the chamber 40 and that a central portion of the leaf spring 42 fully engages the flat surface portion 43 of the shaft 34 when the flapper 32 is in its closed position.

The leaf spring 42 and the shaft 34 form a system for counter-acting initial rotation of the flapper element 32 from the closed position to the open position thereof as a result of flow of the stream of fluid against the surface portions 36, 37 of different surface areas.

Figure 4:
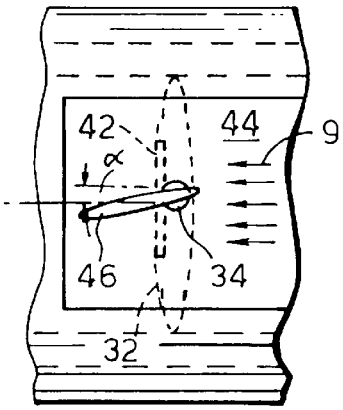
FIG. 4 schematically shows side view 4—4 of FIG. 2.

Referring further to FIG. 4 the shaft 34 extends into a recess 44 provided at the outside of the valve body 10. A vane element 46 is arranged in the recess 44 and fixedly connected to the shaft 34 in a manner that the vane element 46 extends at a selected angle $\alpha$ relative to the direction of flow 9 when the flapper element 32 is in its closed position (the flapper element 32 and the leaf spring 42 are indicated in phantom lines in FIG. 4).

The vane element 46 forms a trigger means for triggering said initial rotation of the flapper element against the action of the system for providing said torque when the flow rate of the stream exceeds a selected threshold flow rate.

The shaft 34 is furthermore provided with a spiral spring 48 (FIG. 2) which biases the shaft 34 to the position in which the flapper element 32 is in the closed position thereof.

During normal operation a stream of hydrocarbon gas produced from the earth formation flows at a normal flow rate through the casing 3 in the direction 9 to the safety valve 6. The flapper element 32 is in its closed position by the action of the spiral spring 48 and the action of the leaf spring 42, and the closure element 18 is in its open position by the action of the tension spring 24.

The flapper element 32 prevents flow of the stream of gas into the valve body 10 and against the closure element 18. Furthermore, the stream of gas exerts a drag force to the vane element 46 acting so as to align the vane element with the stream and to cause thereby initial rotation of the flapper element 32. However such alignment is countered by the action of the leaf spring 42 as long as the flow rate of the stream does not exceed the threshold flow rate.

The stream of gas flows from via the slots 12 to the valve opening 16 and from there to the gas outlet 14. From the gas outlet 14 the gas flows further through the casing 3 in the direction 9 to a processing facility (not shown) at surface.

If the flow rate of the stream exceeds the threshold flow rate, for example due to an undesired pressure drop at the processing facility at surface, the drag force exerted to the vane element increases and causes the vane element to align with the stream and thereby to rotate the axis 43 and the flapper element 32 against the action of the leaf spring 42 biasing against the shaft 34. As the axis 34 rotates, the leaf spring 42 increasingly bends until the leaf spring 42 becomes engaged against the cylindrical portion of the hinge axis 34. Further rotation of the hinge axis 34 is then no longer counter-acted by the leaf spring 42, and the flow of the stream against the flapper element 32 provides a turning moment causing the flapper element 32 to rotate to its open position. With the flapper 32 in its open position, the stream is allowed to flow into the valve body 10 and against the closure member 18. As a result the closure member 18 becomes subjected to a hydraulic force applied by fluid flow 9, which causes the closure member 18 to move to the closed position thereof against the action of the spring 24. Any further flow through the safety valve 6 is thereby prevented. In the absence of flow, the vane element 46 is no longer subjected to a drag force thereby allowing the spiral spring 48 to bias the flapper 32 back to its closed position. The closure member 18 will retain its closed position as long as a pressure difference across the closure member 18 prevents returning of the closure member 18 to its open position.

When production is to be resumed the gas pressure at the surface facility is raised so that the spring force of spring 24 urges the closure member 18 again to its open position.

Figure 5:
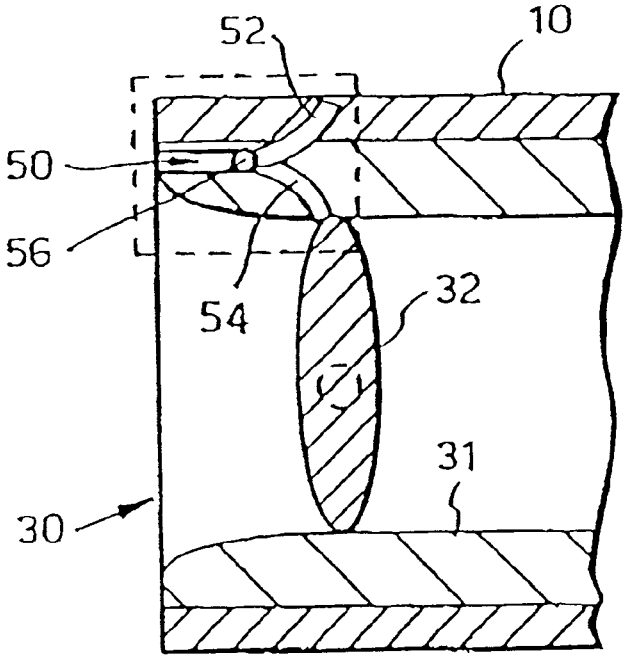
FIG. 5 schematically shows a detail of alternative embodiment of a downhole safety valve according to the invention.
Figure 6:
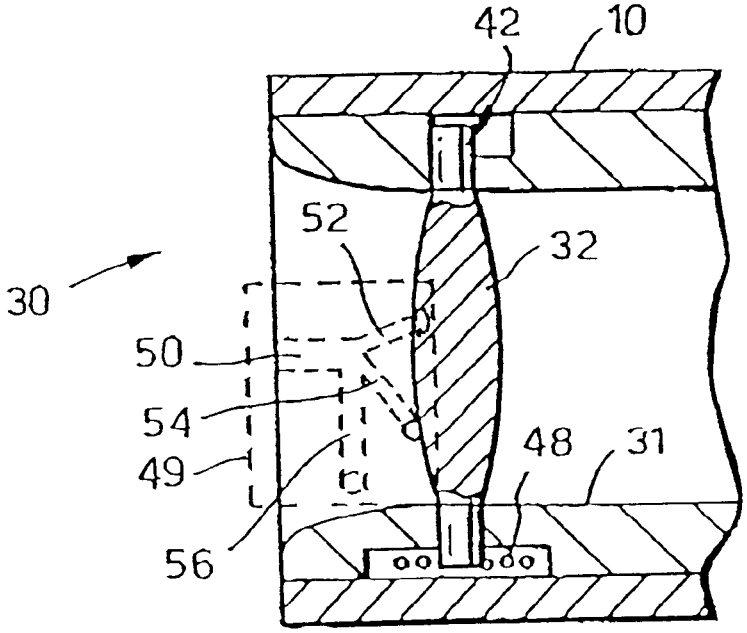
FIG. 6 is a top view of FIG. 5.

Referring to FIGS. 5 and 6, there is shown a detail of an alternative embodiment of a safety valve according to the invention, which alternative embodiment is largely similar to the embodiment described with reference to FIGS. 1–4, except that the trigger means is a fluidic trigger device 49 instead of the vane element referred to hereinbefore. In FIG. 5 is shown the upstream end part of the alternative embodiment including the valve housing 10, the flapper valve 30, the valve body 31, the flapper element 32, the leaf spring 42 and the spiral spring 48.

The fluidic trigger device 49 includes a fluid inlet 50, a first fluid outlet 52 and a second fluid outlet 54. A port 56 provides fluid communication between the exterior of the valve housing 10 and the junction between the first outlet 52 and the second outlet 54. The second outlet 54 is arranged so that a fluid stream leaving the second outlet 54 flows against the larger one of the surface portions 36, 37. The inlet 50, the outlets 52, 54, and the port 56 are so arranged that if the flow rate of the stream of gas does not exceed the threshold flow rate, a sub-stream of the stream of gas entering the inlet 50 leaves the device 49 through the first outlet 52, and that if the flow rate of the stream of gas exceeds the threshold flow rate, the sub-stream leaves the device 49 through the second outlet 54. The sub-stream is diverted into the second outlet 54 by virtue of a decreased pressure in port 56 at the higher flow rate of the stream of gas.

Normal operation the alternative embodiment is similar to normal operation of the embodiment described with reference to FIGS. 1–4, except that instead of initial rotation of the flapper element being triggered by the vane element, such initial rotation is being triggered by the fluidic trigger 49.

Instead of the leaf spring biasing against the cam surface of the shaft so as to counter-act initial rotation of the flapper element, a solenoid activated element can be biased against the cam surface so as to counter-act initial rotation of the flapper element. Preferably the solenoid activated element is biased against the cam surface if electric power is provided to the solenoid, and retracted from the cam surface if no power is provided to the solenoid.

What is claimed is:

1. A safety valve for use in a wellbore formed in an earth formation, comprising (a) a valve body having a fluid passage for passage of a stream of hydrocarbon fluid flowing from the earth formation via the wellbore to the earth surface;

(b) a closure member movable relative to the valve body between an open position in which the fluid passage is open and a closed position in which the closure member closes the fluid passage;

(c) an activating device for selectively subjecting the closure member to a drag force of selected magnitude, the drag force being exerted by the stream of fluid and inducing the closure member to move from the open position to the closed position thereof; and (d) control means for controlling the activating device to subject the closure member to said drag force.

2. The safety valve of claim 1, wherein the activating device is operable between a first mode in which flow of the stream of fluid against the closure member is substantially prevented, and a second mode in which flow of the stream of fluid against the closure member is allowed.

3. The safety valve of claim 2, wherein the closure member is arranged in a conduit and wherein in said first mode the activating device substantially prevents flow of the stream of fluid into the conduit, and in said second mode the activating device allows flow of the stream of fluid into the conduit.

4. The safety device of claim 3, wherein the activating device includes a flapper valve having a flapper element arranged upstream the closure member, which flapper element is rotatable between a closed position in which the flapper element substantially closes the conduit and an open position in which the flapper element substantially leaves the conduit open.

5. The safety valve of claim 4, wherein the flapper element is rotatable about an axis dividing the flapper element in portions of different surface areas, and wherein the control means includes a system for exerting a selected torque to the flapper element, said torque counter-acting initial rotation of the flapper element from the closed position to the open position thereof as a result of flow of the stream of fluid against the flapper element.

6. The safety valve of claim 5, wherein the flapper element is fixed to a shaft rotatable about said axis of rotation and the system for exerting said torque includes a cam surface provided to said shaft and a selected one of a spring activated element biased against the cam surface and a solenoid activated element biased against the cam surface.

7. The safety valve of claim 6, wherein the cam surface includes a substantially flat surface portion of the shaft.

8. The safety valve of any one of claims 5–7, wherein the control means includes trigger means for triggering said initial rotation of the flapper element against the action of the system for providing said torque.

9. The safety valve of claim 8, wherein the trigger means is arranged to trigger said initial rotation of the flapper element when the flow rate of the stream exceeds a selected threshold flow rate.

10. The safety valve of claim 9, wherein the trigger means includes a vane element arranged in the stream and being rotatable about said axis at a fixed angular orientation relative to the flapper element such that the vane element is out of alignment with the stream when the flapper element is in the closed position thereof.

11. The safety valve of claim 9, wherein the trigger means includes a fluidic trigger device having a fluid inlet, a first fluid outlet arranged to direct a sub-stream of the stream of fluid entering the fluid inlet onto a selected one of said portions of the flapper element, a second outlet arranged to direct the sub-stream away from the flapper element, and means for diverting the sub-stream from a selected one of said outlets to the other one of said outlets.

12. A safety valve for use in oil and gas production, comprising:

(a) a valve body having a fluid flow passage therethrough;

(b) a closure member disposed within said valve body, said closure member being moveable from a first position, permitting flow through said valve body, and a second position, blocking flow through said valve body, said closure member being biased to said first position; and (c) a fluid powered actuator and pilot actuator for moving said closure member from said first position to said second position in response to fluid flow in excess of a predetermined flow level.

13. The safety valve of claim 12, wherein said fluid powered actuator is selectively moveable, from a first position, wherein fluid flow does not act upon said closure member and a second position, wherein said fluid flow operates to move said closure member from said first position to said second position.

14. The safety valve of claim 13, wherein said fluid powered actuator comprises a flapper valve disposed in said valve body upstream of said closure member.

15. The safety valve of claim 14, wherein said flapper valve is comprised of a flapper element rotatably mounted in said valve body, said flapper element being biased to said first position.

16. The safety valve of claim 15, wherein said pilot actuator comprises a flow diverter, responsive to flow in excess of said predetermined levels operates to rotatably displace said flapper element in said fluid flow, moving said flapper element to said second position.

17. The safety valve of claim 12, wherein said pilot actuator, in response to fluid flow in excess of a predetermined level, displaces said fluid powered actuator in said fluid flow, said fluid flow moving said fluid powered actuator from said first position to said second position.

* * * * *